US005133548A

United States Patent [19]

Bedord et al.

[11] Patent Number: 5,133,548

[45] Date of Patent: Jul. 28, 1992

[54] PITCHING TRAINER WITH AUTOMATIC BALL RETURN

[76] Inventors: Joseph P. Bedord II, 6809 Mackey, Overland Park, Kans. 66204; Jeffrey J. Bedord, 4130 W. 54th Ter., Roeland Park, Kans. 66205

[21] Appl. No.: 625,810

[22] Filed: Dec. 11, 1990

[51] Int. Cl.[5] ..... A63B 69/40

[52] U.S. Cl. ..... 273/26 A; 273/410

[58] Field of Search ..... 273/26 A, 29 A, 181 F, 273/405, 407, 410, 26 D

[56] References Cited

U.S. PATENT DOCUMENTS

| | | | |
|---|---|---|---|
| 1,170,715 | 2/1916 | Westgate | 273/26 A |
| 1,923,297 | 8/1933 | Cooper | 273/26 A |
| 2,040,228 | 5/1936 | Whiteley | 273/26 A |
| 2,059,365 | 11/1936 | King | 273/29 A |
| 2,254,986 | 9/1941 | Ziel | 273/26 A |
| 2,657,058 | 10/1953 | Mulchay | 273/26 A |
| 2,657,931 | 11/1953 | Burell | 273/26 A |
| 2,805,070 | 9/1957 | Waters . | |
| 2,895,737 | 7/1959 | Blees . | |
| 3,194,556 | 7/1965 | Vinson | 273/26 A |
| 3,408,071 | 10/1968 | Lundy | 273/26 A |
| 3,711,092 | 1/1973 | Hogue . | |
| 3,724,437 | 4/1973 | Halstead . | |
| 3,766,901 | 10/1973 | Cleary et al. . | |
| 3,989,246 | 11/1976 | Brown et al. | 273/29 A |
| 3,999,754 | 12/1976 | Krzystofiak | 273/30 |
| 4,127,272 | 11/1978 | Pennell . | |
| 4,197,827 | 4/1980 | Smith . | |
| 4,199,144 | 4/1980 | Garcia | 273/26 A |
| 4,206,916 | 6/1980 | Epply | 273/26 A |
| 4,368,885 | 1/1983 | Katada et al. | 273/29 A |
| 4,390,181 | 6/1983 | Parish | 273/26 A |
| 4,531,504 | 7/1985 | Gilreath . | |
| 4,552,120 | 11/1985 | Nall et al. . | |
| 4,643,423 | 2/1987 | Wright . | |
| 4,772,017 | 9/1988 | Ericksen | 273/29 A |
| 4,883,272 | 11/1989 | Lay . | |
| 4,974,843 | 12/1990 | Henningsson | 273/29 A |

FOREIGN PATENT DOCUMENTS 642980 9/1950 United Kingdom .

*Primary Examiner*—Theatrice Brown

*Attorney, Agent, or Firm*—Hovey, Williams, Timmons & Collins

[57] ABSTRACT

A pitching trainer includes an automatic ball return includes a frame defining a ball-receiving chamber including a cushion at the back wall of the chamber, a floor therebeneath, and a ball-expelling machine connected to the floor for returning a ball cast into the chamber to the user. The cushion is configured to absorb the impact of the ball and allow it to drop onto the floor, which is preferably smooth-surfaced, inclined and provided with a hole through which the ball may pass to the ball-expelling machine. The cushion is provided with a target area, and an indicator which signals when a ball impacts the target area. A ramp may be provided at the front of the trainer whereby a ball directed below the floor of the chamber may be guided therein, and the ramp may be provided with indicia corresponding to a specific sport to assist the user in his efforts to hit the target area.

5 Claims, 4 Drawing Sheets

PITCHING TRAINER WITH AUTOMATIC BALL RETURN

BACKGROUND OF THE INVENTION

1. Field of the Invention

This invention broadly concerns a pitching trainer for presenting a pitcher with a receiver and a ball return mechanism in substitution of a human catcher. In particular, the pitching trainer hereof includes a frame for supporting netting and a ball-engaging cushion at the back thereof and includes an automatic ball return for expeditiously returning the ball to the pitcher.

2. Description of the Prior Art

The pitcher in a baseball game spends many hours perfecting his craft. The pitched baseball must arrive at the plate with sufficient velocity to minimize the hitter's reaction time and be in a location defined by the "strike zone". As the level of competition increases in intensity, the pitcher may need to throw pitches which curve as well as very fast pitches. This ordinarily requires a human catcher to receive and return the ball to make the practice session more enjoyable and efficient. When catchers are unavailable, an alternate receiving means is necessary to provide the pitcher with suitable practice time.

In response to this need, a number of training devices have been developed. In some cases, such as the pitching target shown in U.S. Pat. No. 4,643,423, the trainer has no mechanism for returning the ball to the user but merely acts as a stop. In other circumstances, such as shown in U.S. Pat. No. 3,711,092, the target also serves to rebound the ball to the pitcher.

A pitcher trainer having a ball return machine is shown in U.S. Pat. No. 4,883,272. The machine shown therein employs a frame which employs netting that drapes therefrom and a netted floor which serves to allow the ball to return to a ball-returning machine. Unfortunately, this and the other devices known in the prior art are unsuitable for professional-caliber athletes, and in particular baseball pitchers. Professional pitchers routinely throw a baseball at speeds exceeding eighty-five miles per hour when the baseball reaches the target area, and in some instances the speed may exceed one hundred miles per hour. The combined velocity and mass of the ball impacting the target or frame of these prior art devices may buckle the assembly, cause the ball to pass through or around the side of the target, or otherwise dismantle the unit.

The existing pitching training devices also fail to accommodate low-throwing pitchers where the thrown ball may go beneath the apparatus. This is especially a problem when the skilled pitchers throw curves or other breaking pitches which are typically prone to bouncing in front of the plate.

Another problem with prior art devices is the inability to return the pitch, or to return it in the time desired by professional athletes. The existing devices typically slow the ball, but do not provide for an immediate ball return. The prior art devices also fail to provide a reliable indicator of when a pitch is within the target area to positively indicate the number of strikes including those strikes known as being "on the black" of the plate.

Finally, most prior art trainers are difficult to transport and must be carried or disassembled for moving or storage.

SUMMARY OF THE INVENTION

These and other problems are largely solved by the pitching trainer in accordance with the present invention. That is to say, the pitching trainer hereof is capable of quickly and accurately receiving and returning a pitch thrown by professional-level athletes, is extremely durable in use, accurately reflects whether a pitch is a "strike", accommodates low pitches by use of a ramp, and is easily transportable by virtue of an integral wheeled carriage.

In greater detail, the pitching trainer hereof includes a frame defining a front opening which supports a back wall and opposed side walls. Each of the side walls is preferably composed of netting to restrain the ball in a ball-receiving chamber while enabling outside observation. The back wall is preferably a padded cushion which absorbs the impact of the ball without significant rebound, allowing the ball to quickly drop to a floor therebeneath. The floor is preferably smooth and inclined and provided with a hole for discharging the ball. A track or conduit serves to convey the ball to a ball-expelling machine, which advantageously impels the ball in a forward direction to return it to the pitcher. In practice, the entire cycle from engagement of the ball with the cushion to return of the ball to the pitcher takes less than five seconds.

In preferred embodiments, the trainer hereof includes signalling means for indicating contact between the cast ball and a target area defined on the cushion. The signalling means may include a light or other visually perceptible indication that the target has been hit. A ramp may be provided to extend forwardly and downwardly of the chamber for directing low balls up and into the chamber. The ramp may include indicia such as a batter's box or home plate for aiding the user to throw into the chamber and provide a visual image corresponding to an actual baseball environment.

The trainer may also advantageously include a wheeled carriage for enabling easy movement of the trainer from place to place. The carriage may be adjustably mounted on the frame defining the chamber so that it may be pivoted to support the trainer in the desired attitude.

The frame itself is constructed so that the ball-expelling machine is attached to the frame, whereby the entire apparatus may be moved as a unit by pivoting it up and onto the wheeled carriage. The ball-expelling machine is located forwardly and at the side of the unit to counterbalance the unit against the impact of the ball against the cushion and to limit exposure the ball-expelling machine to the pitched ball as well as enable employment of the ramp. Finally, the ball-expelling machine includes an adjustable discharge tray whereby the loft imparted to the ball expelled thereby may be varied.

DESCRIPTION OF THE PREFERRED EMBODIMENT

Figure 2:
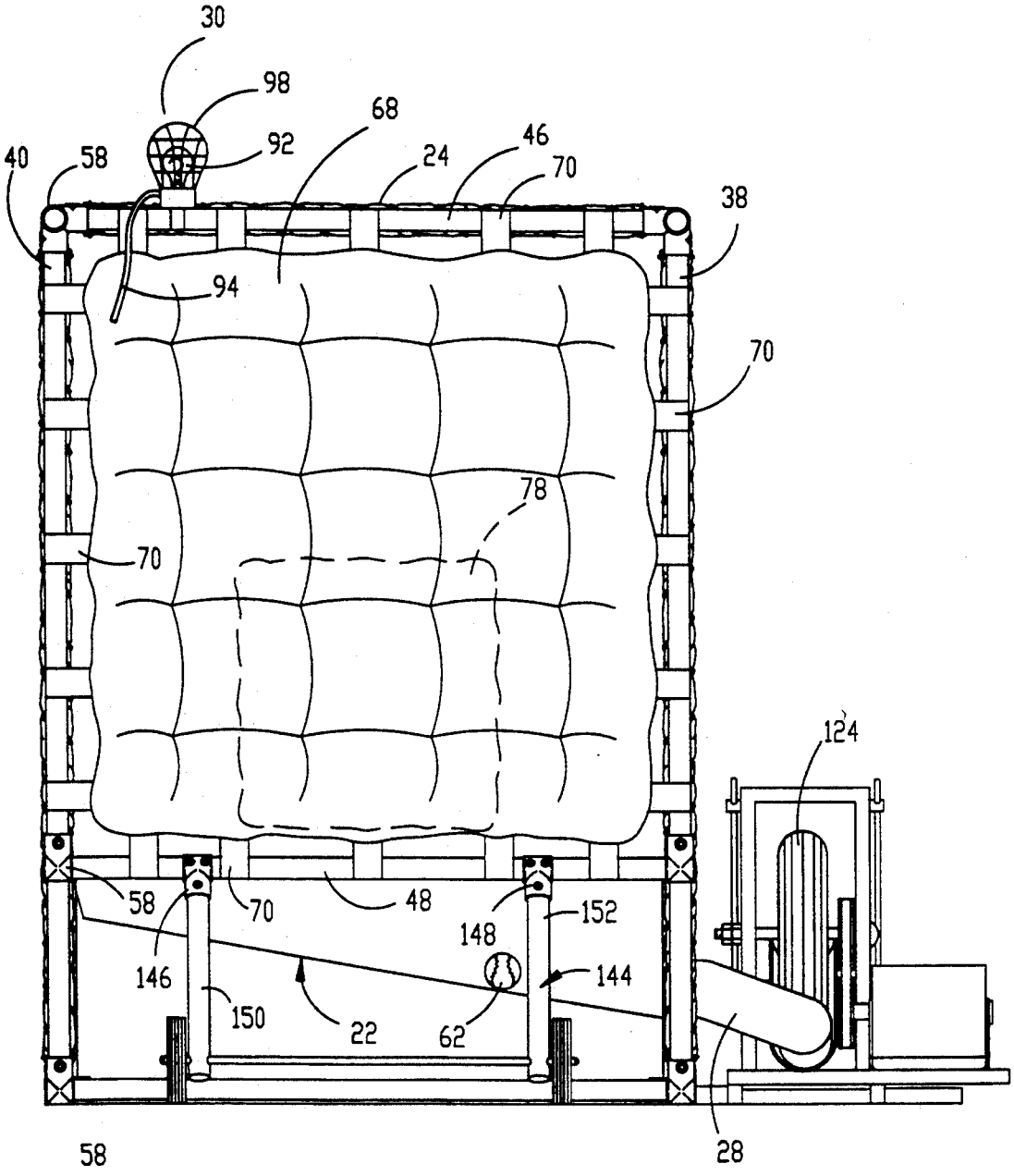
FIG. 2 is a fragmentary rear elevational view with a portion of the electrical cable connecting a switch inside the cushion with an indicator light broken away.

Referring now to the drawing, pitching trainer apparatus 10 broadly includes frame 12 defining a ball-receiving chamber 14. Chamber 14 is enclosed by back wall 16, left side wall 18 and right side wall 20, leaving a substantially open area 21 at the front of the chamber 14. The chamber 14 is further defined by floor 22 best seen in FIG. 2 and a roof 24 defined by netting extending thereacross. Apparatus 10 further includes ball-expelling machine 26, connecting tube 28, signalling means 30 and ramp 32.

In greater detail, frame 12 includes a pair of frontmost upright support posts 34 and 36 and a pair of rearmost upright support posts 38 and 40. A pair of frontmost transversely oriented members including upper front transversely oriented member 42 and lower front transversely oriented member 44 interconnect frontmost upright support posts 34 and 36 while a second rearmost pair of transversely oriented members including upper rear member 46 and lower rear member 48 interconnect rearmost upright support posts 38 and 40. Frame 14 also includes upper left side fore-and-aft connecting arm 50 and lower left side fore-and-aft connecting arm 52 interconnecting frontmost upright support post 34 and rearmost upright support post 38, as well as upper right side fore-and-aft connecting arm 54 and lower right side fore-and-aft connecting arm 56 which interconnect frontmost upright support post 36 and rearmost upright support post 40. At each intersection between upright support posts, fore-and-aft connecting arms and transversely oriented members, a three-way elbow 58 is provided which includes set screws for connecting the respective support posts, connecting arms and transversely oriented members into a rigid frame 12.

The frame 12 serves as a support for netting 60. Left side wall 18, right side wall 20 and roof 24 are all formed of netting with a mesh size sufficient to prevent the passage of a ball, such as baseball 62 therethrough. The netting 60 defining the left side wall 18, right side wall 20 and roof 24 is held in position by cording 64 wrapped around the respective support posts, connecting arms and transversely oriented members. Further, is to be understood that left side wall 18 is defined by netting 60 which extends in a substantially and normally vertical plane between frontmost upright support post 34 and rearmost upright support post 38 and between upper left side fore-and-aft connecting arm 50 and lower left side fore-and-aft connecting arm 52. Right side wall 20 is defined by netting 60 extending in a substantially and normally vertical plane between frontmost upright support post 36 and rearmost upright support post 40, and between upper right side fore-and-aft connecting arm 54 and lower right side fore-and-aft connecting arm 56. Similarly, roof 24 extends in a substantially and normally horizontal plane between upper left side fore-and-aft connecting arm 50 and upper right side fore-and-aft connecting arm 54 and between front upper transversely oriented member 42 and upper rear transversely oriented member 46. The netting 60 and support posts 34 and 36 as well as upper front transversely oriented member 42 are protected against occasional impact from the ball 62 by padding 66 wrapped therearound and held in place by cording 64. It is to be understood that the padding 66 could be of a variety of materials, but it has been found that nylon covered sponge rubber works well for this application.

Figure 4:
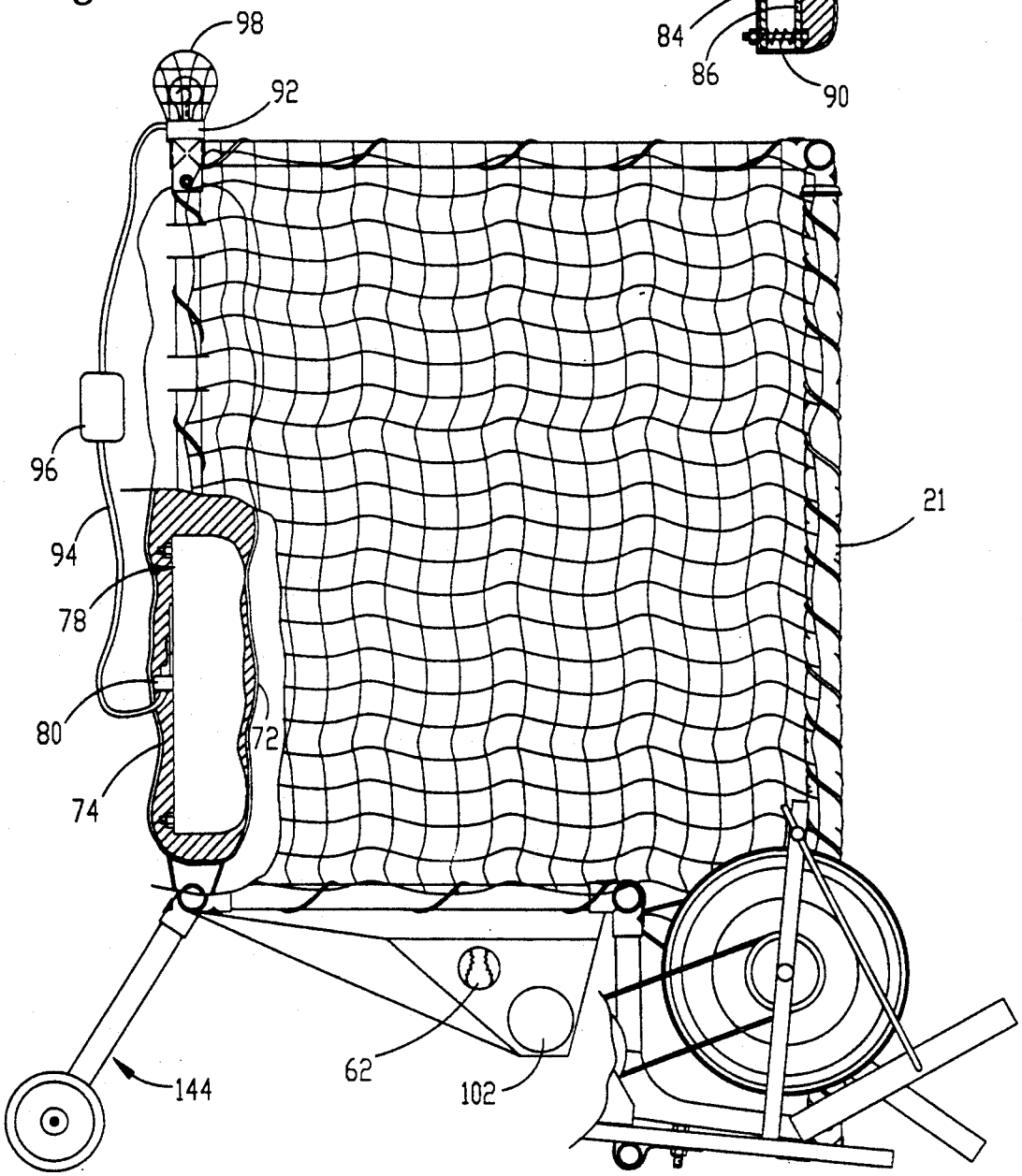
FIG. 4 is a left side elevational view of the apparatus hereof similar to FIG. 3, but breaking away a portion of the netting to show the panel within the cushion in cross-section, and including the power source interconnecting the indicator light and the actuating switch, with portions of the expelling machine broken away for clarity.

Extending across the rear of the ball-receiving chamber 14 is a cushion 68 defining back wall 16. Cushion 68 is supported in a substantially and normally vertical plane by webbing 70 extending outwardly at intervals therearound and over upper rear transversely oriented member 46, lower rear transversely oriented member 48 and rearmost upright support posts 38 and 40 along its respective top, bottom, left and right edges, respectively and substantially span the area defined by the aforementioned upright support posts and transversely oriented members. As best seen in FIG. 4, cushion 68 presents a front panel 72 and a rear panel 74 which are preferably of canvas and surround the fibrous contents of the cushion 68. The fibrous contents 76 may include any of a number of suitable padding materials such as cotton, Dacron polyester or other natural or synthetic fiber. In order to satisfactorily absorb the impact of a baseball 62, it has been found that the padding should ordinarily be about three to six inches thick, and preferably about four and one-half inches.

Figure 5:
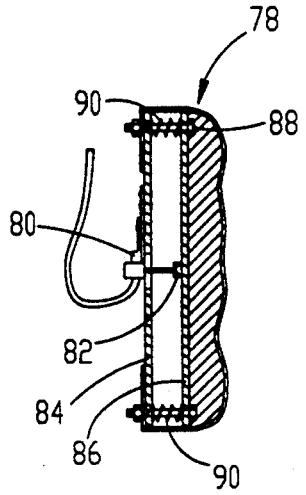
FIG. 5 is a fragmentary cross-sectional view of the signalling means panel normally embedded in the cushion.

Embedded within a portion of cushion 68 is signal activator 78 as shown in FIGS. 4 and 5. Signal activator 78 includes a normally open switch 80 and it has been found that a Unimax 2HBL-1 is satisfactory for this purpose, preferably modified to include a roller 82 mounted on the arm thereof. A pair of substantially co-planer spaced wooden rectangular sheets 84 and 86 are bolted together at four corners thereof by bolts 88 and spaced apart by tensioning springs 90. The wooden sheet 84 is apertured at the center to enable the arm and roller 82 of switch 80 to pass therethrough for engagement with the back side of sheet 86. The tensioning springs 90 provide only slight compression resistance such that they enable front wooden sheet 86 to move rearwardly upon engagement of the portion of front panel 72 covering the signal activator with a thrown or otherwise cast ball 62. As may been seen in FIG. 4, switch 80 is connected to an indicator lamp 92 by electrical cord 94. The illumination system is powered by a 6-volt rechargeable battery 96 to minimize the hazard from fire which might occur if a higher voltage power source was provided. A cage 98 preferably covers the indicator lamp 92 to protect the same against breakage from an errantly thrown ball.

Floor 22 defines a trough 100 for directing ball 62 downwardly toward a hole 102 therein. The floor 22 is preferably composed of a plurality of inclined panels 104, 106 and 108 which present a smooth, even and uninterrupted service for routing the ball toward hole 102. Such panels may be provided of any suitable material having the above characteristics such as sheet metal, wood and synthetic resin material, and the preferred embodiment employs translucent polycarbonate sheets to accomplish this purpose. The floor 22 is mounted to the frame 12 by brackets and positioned beneath cushion 68 and extends forwardly thereof as best seen in FIG. 3.

Figure 3:
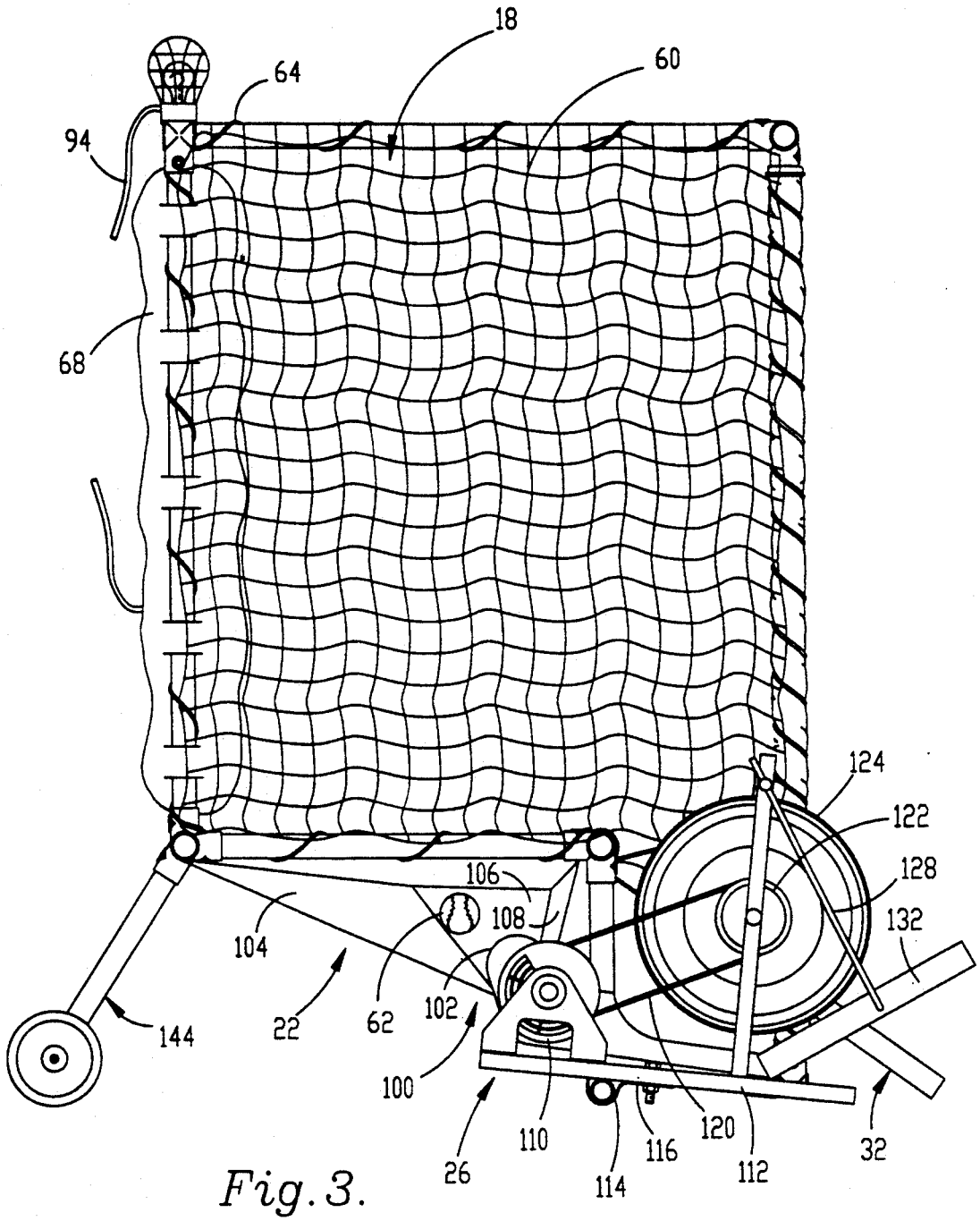
FIG. 3 is a fragmentary left side elevational view thereof.

Also as seen in FIG. 3, ball-expelling machine 26 includes an electric motor 110 mounted on a platform 112 connected to frame 12 by transversely extending pipe 114 and bracket 116. Because motor 110 is relatively remote from cushion 68, it may be powered by conventional a 110-volt current. Motor 110 drives pulley 118 connected by a belt 120 which in turn drives pulley 122. Pulley 122 is mounted on a shaft so as to drive expelling wheel 124 when rotated by pulley 120. A support 126 elevates pulley 122 and wheel 124 relative to platform 112 and in turn pivotally mounts rods 128 and 130 for adjusting the level of inclination of discharge tray 132.

Connecting tube 28 interconnects hole 102 and ball-expelling machine 26. As may be seen in FIG. 2, connecting tube 28 routes a ball discharge through hole 102 beneath wheel 124 and is aligned with discharge tray 132.

Figure 1:
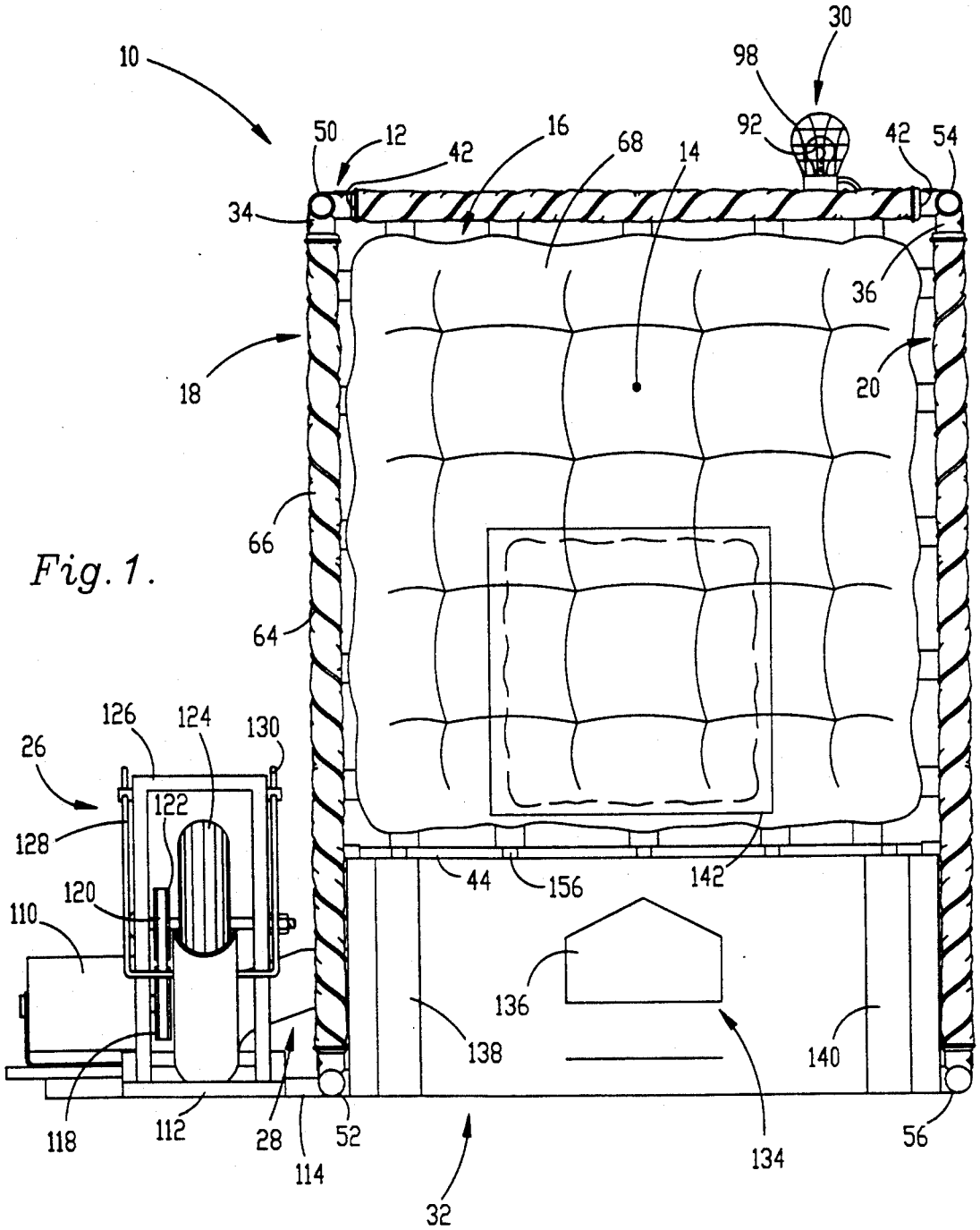
FIG. 1 is a front elevational view of the pitching trainer of the present invention, showing a ramp extending downwardly and forwardly of a ball-receiving chamber.

Referring again to FIG. 1, ramp 32 includes sports-related parameter defining indicia 134 thereon. In the preferred embodiment for baseball, these include a home plate indicia 136 and batter's box striping 138 and 140. These indicia are preferably of a contrasting color to the background of ramp 32 to provide ready identification by the user as an aid to identifying a desired target.

Cushion 68 includes target area defining indicia 142. The target area may vary according to the level of skill and the size of the batter's the pitcher would normally confront. The signal activator 78 is shown in phantom in FIGS. 1 and 2 and is located within cushion 68 in a position normally corresponding to the strike zone including the "black part" of the plate which is the most desired location for a pitch. The target area defining indicia 142 is located so as to be visible on the front panel 72 of the cushion 68 immediately in front of the signal actuator 78.

A wheeled carriage 144 is adjustably mounted to the frame 12, preferably at lower rear transversely oriented member 48. A pair of clasps 146 and 148 connect the support arms 150 and 152 to the frame 12 by set screws 154.

In operation, the pitcher training apparatus 10 hereof may be set up in any convenient location which provides access to conventional electric current. The pitcher withdraws a distance away from the apparatus 10 corresponding to the rules of the league in which he is playing. At any time after energizing the motor, the pitcher may begin throwing.

When the pitcher throws a ball towards the target area defined by indicia 142, the ball will impact cushion 68. The cushion is of sufficient size and thickness to absorb the impact of the thrown ball and permit it to drop downwardly onto the floor 22 with a minimum of delay. Also, because the webbing 70 securely anchors the cushion 68 to the frame 12, the target area remains in the same location after each pitch.

If the pitcher is skillful, the ball will fall within the target area defined by indicia 142. In that case, the ball will impact forwardly of signal actuator 78, causing wooden sheet 86 to move rearwardly and move roller 82 and its connecting arm to close normally open switch 80. When this happens, the circuit between lamp 92, battery 96 and switch 80 is closed and the lamp 92 is temporarily illuminated to indicate a "strike". Tensioning springs 90 then bias wooden sheet 86 away from wooden sheet 84 and switch 80 then returns to its normally open position to de-energize the circuit.

Ball 62 then falls onto floor 22 and rolls along one of the inclined panels 104, 106 or 108 so as to pass through hole 102. The ball is then channeled along connecting tube 28. Electric motor 110 turns wheel 124 through pulley 118 and 122 and belt 120, and as the ball passes beneath the rotating wheel 124, the outer surface of the wheel 124 engages the ball and impels it forwardly at an angle as determined by discharge tray 132. The ball 62 is thereby returned to the pitcher so that a second pitching cycle can begin.

It may be appreciated that the location of the ball-expelling machine 26 at the side of the frame 12 enables the use of ramp 32. Ramp 32 serves not only as a display as described above, but also aids in conveying low balls upwardly toward the ball-receiving chamber 14. In the event the pitcher throws the ball 62 below lower front transversely extending member 44, the ramp will serve to direct some of the balls upwardly into chamber 14 which would otherwise necessitate retrieval by hand.

It should also be understood that the use of netting to define the side walls is particularly useful when the pitcher is throwing breaking pitches. In such circumstances, the ball is constrained by the side walls 18 and 20 which might otherwise escape. Normally, the lateral vector component is relatively small compared to the vector component directed toward the rear of the apparatus 10, and thus the primary force of impact is directed against the cushion 68. The use of netted side walls 16 and 18 and netted roof 24 also make the apparatus 10 hereof useful as a combination pitching and batting trainer. The batter may easily stand to the side of ramp 32 (assuming, of course a right handed batter for the embodiment shown in FIG. 1), and swing at the balls 62 thrown by the pitcher. Most missed pitches, balls and foul-tips will be confined within the apparatus 10, thus avoiding the necessity of using a catcher for batting practice.

When the training session is completed, the pitcher need only tilt the apparatus 10 back onto the wheeled carriage 144 and roll it to its desired storage location. Because the frame 12 and wheeled carriage 144, together with support 126 and many other components associated with ball-expelling machine 26 are of tubular aluminum or other metal, the apparatus 10 is of great enough mass whereby the wheeled carriage 144 is necessary for easy transportation, but light enough to enable one person to move the apparatus 10 by himself. Ramp 32 is preferably detachably mounted on the lower front transversely extending member 44 by clips 156 so that the ramp may be quickly removed and placed inside chamber 14 on floor 22 when not in use.

While many modifications may be made to the invention without departing from the scope thereof, it is to be understood that the foregoing sets forth only the preferred embodiment of the invention and that the scope of protection sought for this invention is to determined by the following claims.

We claim:

1. A pitching trainer for receiving a thrown ball and returning it to a pitcher, said trainer comprising:

a frame presenting a first, frontmost pair of normally upright transversely spaced support posts, a second, rearmost pair of normally upright transversely spaced support posts, an upper frontmost transversely oriented member connecting said frontmost pair of upright support posts and a lower frontmost transversely oriented member positioned rearwardly of said upper frontmost transversely oriented member, a rearward pair of transversely oriented members connecting said rearmost pair of support posts including a rearmost upper member and a rearmost lower member, and two pairs of respective upper and lower fore-and-aft oriented connecting arms interconnecting respective frontmost transversely oriented members and rearmost transversely oriented members;

first and second side walls supported by said frame and extending from said frontmost support posts rearwardly to respective rearmost support posts, said side walls being defined by netting sized to prevent the passage of the ball therethrough, said side walls extending forwardly of said lower frontmost transversely oriented member;

a back wall defined by a cushion extending substantially between said rearmost pair of support posts and substantially between said rearmost upper member and said rearmost lower member, said cushion including a front panel, a back panel and a quantity of impact-absorbing material therebetween, said cushion presenting target-defining indicia thereon;

a floor located beneath said cushion in ball-receiving relationship thereto, said floor including a plurality of smooth, even and uninterrupted panels inclined toward a ball-receiving hole defined in said floor, said floor being elevated relative to a surface supporting said trainer;

a ball expelling machine including motive means for returning the ball to the thrower;

means connecting said floor and the ball expelling machine for enabling the ball to roll from the hole to the ball expelling machine; and a ramp extending rearwardly and upwardly toward and connected to said lower frontmost transversely oriented member and rearwardly of said frontmost uprights support posts, said ramp presenting indicia thereon including home plate indicia, said home plate indicia being positioned on said ramp in spaced relationship forwardly of said target-defining indicia on said cushion, at least a portion of said ramp being located intermediate said first and second side walls.

2. An apparatus as set forth in claim 1, including signalling means associated with said cushion for indicating engagement of the thrown ball with the target area.

3. An apparatus as set forth in claim 1, including a wheeled carriage connected to said frame.

4. An apparatus as set forth in claim 3 wherein said wheeled carriage includes means for adjusting the orientation of the carriage relative to the frame.

5. An apparatus as set forth in claim 1, including additional netting supported by said frame defining a roof oriented in a normally substantially horizontal plane.

* * * * *